US008657248B2

(12) United States Patent
Rowzee et al.

(10) Patent No.: US 8,657,248 B2
(45) Date of Patent: Feb. 25, 2014

(54) SUPPORTING APPARATUS FOR THIN ELECTRONIC PRODUCT

(75) Inventors: Laura Marie Rowzee, Kansas City, MO (US); Andreas Philipp Rowzee, Kansas City, MO (US); Ricardo Salas, Parkville, MO (US)

(73) Assignee: Salero, LLC, Kansas City, MO (US)

( * ) Notice: Subject to any disclaimer, the term of this patent is extended or adjusted under 35 U.S.C. 154(b) by 96 days.

(21) Appl. No.: 13/188,709

(22) Filed: Jul. 22, 2011

(65) Prior Publication Data

US 2012/0018609 A1 Jan. 26, 2012

Related U.S. Application Data

(60) Provisional application No. 61/366,791, filed on Jul. 22, 2010.

(51) Int. Cl.
*A47B 97/04* (2006.01)

(52) U.S. Cl.
USPC .... 248/444; 248/444.1; 206/45.2; 206/45.24; 206/701; 206/37; 224/929; 224/930

(58) Field of Classification Search
USPC ..... 248/444, 444.1, 454, 458, 447, 459; 206/320, 15.24, 45.2, 701, 305, 37, 38; 224/930, 929
See application file for complete search history.

(56) References Cited

U.S. PATENT DOCUMENTS 1,928,806 A * 10/1933 Barcalo ..... 5/639
1,934,254 A * 11/1933 Barcalo ..... 5/639
4,052,944 A * 10/1977 Jennings ..... 108/43
4,346,895 A * 8/1982 Brownlee ..... 273/150
4,537,646 A * 8/1985 Hoyle ..... 156/212
4,544,123 A * 10/1985 Peacock ..... 248/460
4,544,158 A * 10/1985 Kilmonis ..... 273/150
4,750,283 A * 6/1988 Halpern ..... 40/750
4,815,623 A * 3/1989 Levin ..... 220/17.1
5,413,305 A * 5/1995 Leeb ..... 248/460
5,732,849 A * 3/1998 Brooks ..... 220/603
5,898,962 A * 5/1999 McNeal ..... 5/639
6,354,477 B1 * 3/2002 Trummer ..... 224/575
6,415,920 B1 * 7/2002 Tiramani et al. ..... 206/320
6,644,475 B2 * 11/2003 Wilson et al. ..... 206/522
6,748,615 B1 * 6/2004 Tiedemann ..... 5/640
6,763,942 B1 * 7/2004 Yeh ..... 206/320
6,820,852 B2 * 11/2004 Wainscott et al. ..... 248/444.1
7,280,355 B2 * 10/2007 Taylor ..... 361/679.48
7,360,649 B2 * 4/2008 Swaim et al. ..... 206/320
7,588,146 B1 * 9/2009 Salander et al. ..... 206/320
7,735,644 B2 * 6/2010 Sirichai et al. ..... 206/320
7,778,026 B2 * 8/2010 Mitchell ..... 361/679.55
7,992,502 B1 * 8/2011 Davis ..... 108/43

(Continued)

*Primary Examiner* — Nkeisha Smith
(74) *Attorney, Agent, or Firm* — Muncy, Geissler, Olds & Lowe, P.C.

(57) ABSTRACT

A supporting apparatus for a thin electronic product is composed of a main body having a chamber, a plurality of fillers received in the chamber, an external lateral surface, and a locating portion located on the external lateral surface. The thin electronic product can be visibly fastened to the external lateral surface by the locating portion. Because the supporting apparatus can be firmly put on a surface and define a predetermined angle with respect to the surface, while the thin electronic product is fixed to the external lateral surface of the main body, the thin electronic product can define the predetermined angle with respect to the surface to allow the user to conveniently operate the thin electronic product.

9 Claims, 11 Drawing Sheets

(56) References Cited

U.S. PATENT DOCUMENTS

| | | | | |
|---|---|---|---|---|
| 8,109,421 | B2 * | 2/2012 | McLean et al. | 224/270 |
| 2001/0035444 | A1 * | 11/2001 | Alis | 224/250 |
| 2002/0185395 | A1 * | 12/2002 | Lindamood | 206/320 |
| 2005/0011920 | A1 * | 1/2005 | Feng | 224/275 |
| 2005/0072893 | A1 * | 4/2005 | Brown | 248/444 |
| 2009/0032667 | A1 * | 2/2009 | Sween et al. | 248/346.03 |
| 2009/0078707 | A1 * | 3/2009 | Chen | 220/592.01 |
| 2010/0044259 | A1 * | 2/2010 | Wang | 206/320 |
| 2010/0122924 | A1 * | 5/2010 | Andrews | 206/320 |
| 2011/0120893 | A1 * | 5/2011 | Rekuc et al. | 206/320 |
| 2011/0204112 | A1 * | 8/2011 | Crandall et al. | 224/572 |
| 2011/0290676 | A1 * | 12/2011 | Kershenstein | 206/37 |
| 2012/0048757 | A1 * | 3/2012 | Ohsawa et al. | 206/320 |
| 2012/0060724 | A1 * | 3/2012 | Doss et al. | 108/43 |
| 2012/0145499 | A1 * | 6/2012 | Shor et al. | 190/109 |

* cited by examiner

SUPPORTING APPARATUS FOR THIN ELECTRONIC PRODUCT

PRIORITY TO PRIOR PROVISIONAL APPLICATION

Priority is claimed to Provisional Application Ser. No. 61/366,791, filed on Jul. 22, 2010, the entire content of which is hereby incorporated by reference in this application.

BACKGROUND OF THE INVENTION

1. Field of the Invention

The present invention relates generally to a supporting apparatus, and more particularly, to a supporting apparatus for a thin electronic product.

2. Description of the Related Art

A common thin electronic product, like iPad, tablet computer, PDA, or mobile phone, usually needs a protective bag for storage thereof and protection against collision or a protective case equipped with a protective cover, which can be uncovered or closed. When the protective cover is uncovered to expose the thin electronic product and then put it on the tabletop or other planar surface for operation.

In the market, a strut is available for placing the thin electronic product thereon and can adjust the inclined angle of the thin electronic product with respect to the tabletop or planar surface. However, the aforesaid strut can only be put on the tabletop and the user needs to force himself or herself to where the thin electronic product is mounted for operation thereof. The conventional protective case though can be supported on the tabletop or a planar surface by uncovered protective cover thereof to allow the thin electronic product to form an inclined angle with respect to the tabletop or the planar surface for facilitating the user's operation, but it is impossible to use the aforesaid protective case on a non-flat surface.

In addition, the user can though put the thin electronic product into a common backpack or handbag, but the user needs to rummage around in the backpack or handbag for it and then take it out before using it. The user also needs to hold it with one hand or put it on the tabletop or planar surface for operation, so it is not very convenient.

SUMMARY OF THE INVENTION

The primary objective of the present invention is to provide a supporting apparatus, of which structure can be changed to be positioned on a surface to allow a thin electronic product supported by the supporting apparatus to be placed on a surface of either object.

The secondary objective of the present invention is to provide a supporting apparatus, which allows the user to observe and operate a thin electronic product at the same time and allow the user to conveniently carry and operate it while the user is walking.

The foregoing objectives of the present invention are attained by the supporting apparatus composed of a main body and a plurality of fillers. The main body includes a chamber for receiving the fillers, an external lateral surface, and a locating portion located on the external lateral surface. The thin electronic product can be visibly fastened to the external lateral surface by the locating portion. Because the supporting apparatus can be stably put on a variety of surfaces including flat and non-flat surfaces and define the predetermined angle with respect to the surface, while the thin electronic product is fixed to the external lateral surface of the main body, the thin electronic product can define the predetermined angle with respect to the surface. At the aforesaid predetermined angle, the user is allowed to conveniently operate and watch the thin electronic product and watch the screen thereof.

The supporting apparatus of the present invention can further include a protective shield mounted to the main body. The protective shield is covered onto the external lateral surface of the main body to protect the thin electronic product. The protective shield can be uncovered from the external lateral surface of the main body.

The supporting apparatus of the present invention can further include an anti-skid portion mounted to the external lateral surface of the main body for holding the thin electronic product more firmly.

The supporting apparatus of the present invention can further include a carrying strap having two end portions and two bridge portions close to the two end portions separately. The two end portions are mounted between, not close to, a top side and a bottom side of the main body and spaced from each other. The two bridge portions are detachably mounted to a left side and a right side of the main body. When the two bridge portions are mounted to the left and right sides of the main body, the user can carry the supporting apparatus by the carrying strap slung over the shoulder. When the two bridge portions are not mounted to the left and right sides of the main body, the user can sling the carrying strap over the neck and make the external lateral surface of the main body face upward in such a way that the user can operate the thin electronic product while the user is walking.

In the supporting apparatus of the first preferred embodiment of the present invention, a transparent film coats the external lateral surface of the main body. An opening is formed at the external lateral surface of the main body and at least one of lateral sides of the transparent film. The transparent film and the external lateral surface of the main body jointly define the locating portion. In this way, the thin electronic product can be received between the transparent film and the external lateral surface of the main body.

In the supporting apparatus of the second preferred embodiment of the present invention, four interconnected side strips are mounted to the external lateral surface of the main body, surrounding a peripheral edge of the external lateral surface of the main body. At least one of the side strips and the external lateral surface of the main body form an opening which can be wide-open or closed. The side strips and the external lateral surface of the main body jointly define the locating portion. In this way, the thin electronic product can be received between the side strips and the external lateral surface of the main body.

In the supporting apparatus of the third preferred embodiment of the present invention, at least five sleeve portions are mounted to the peripheral edge of the external lateral surface of the main body and spaced from each other, a springy string passing through the sleeve portions, and a tightener for the springy string to pass through. The sleeve portions, the springy string, the tightener, and the external lateral surface of the main body jointly define the locating portion to fasten the thin electronic product onto the external lateral surface of the main body.

DETAILED DESCRIPTION OF PREFERRED EMBODIMENTS

First of all, the applicant would like to clarify that the same reference signs indicate the same or similar elements in the following embodiments.

Figure 1:
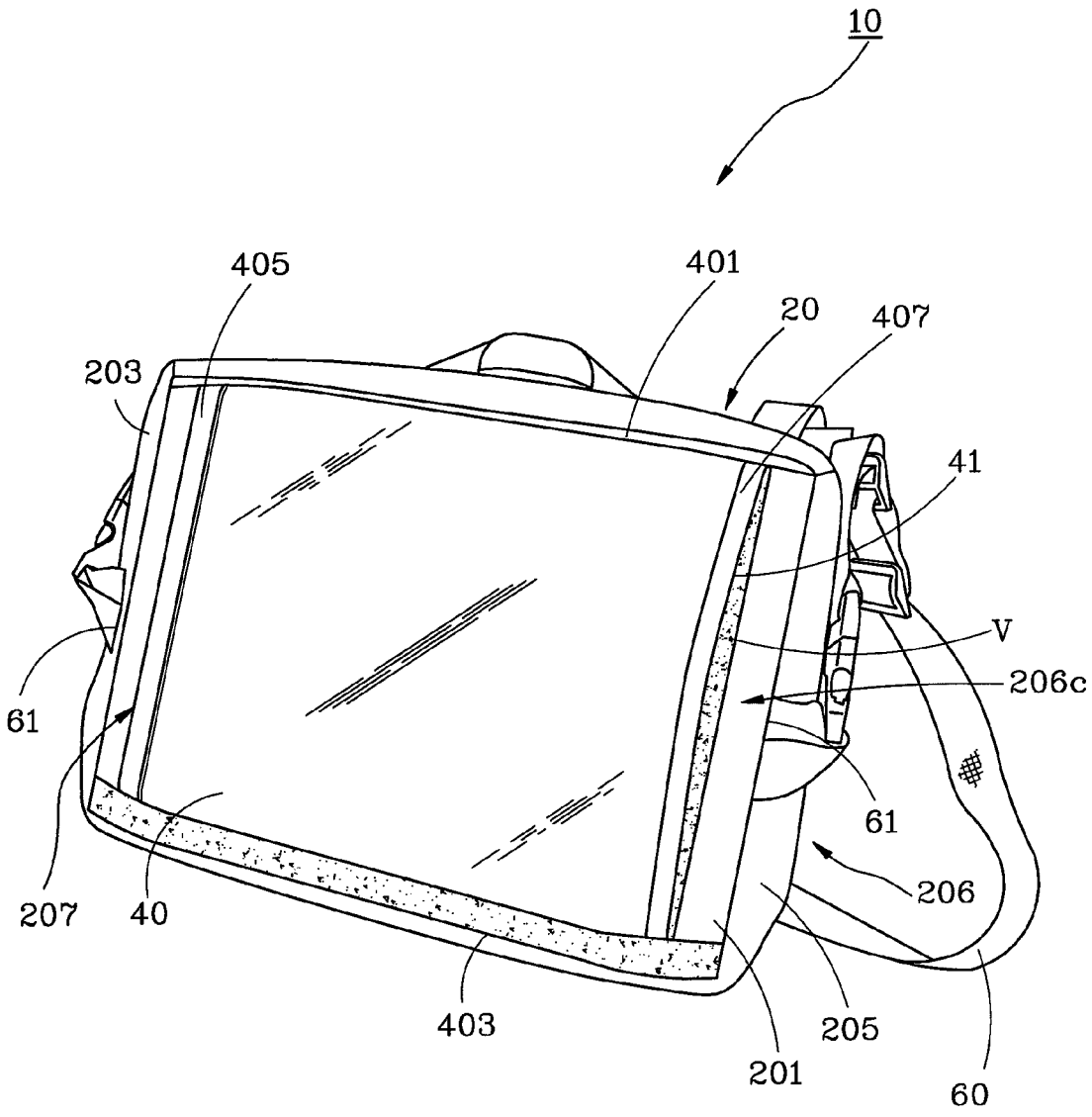
FIG. 1 is a perspective view of a first preferred embodiment of the present invention.
Figure 2:
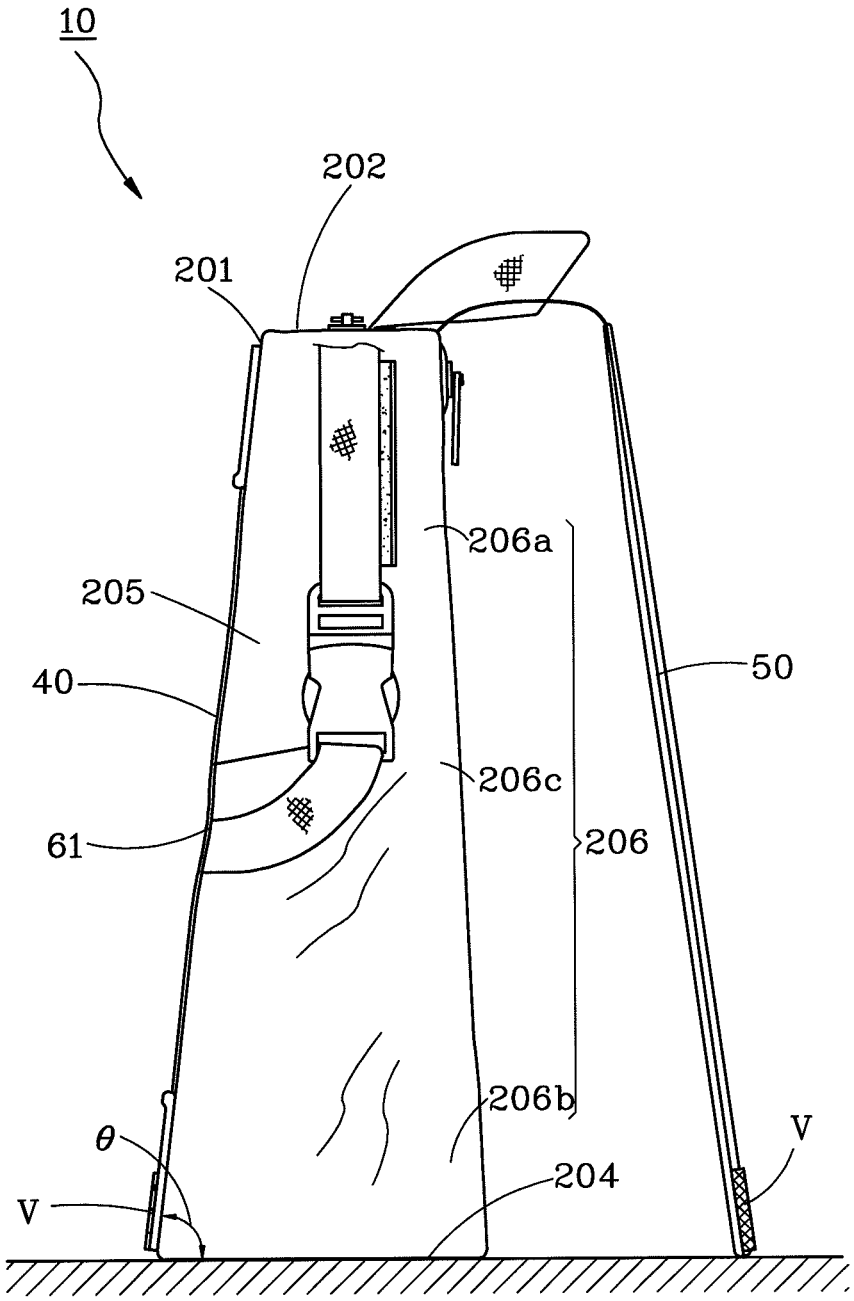
FIG. 2 is a side view of the first preferred embodiment of the present invention which defines a predetermined angle with respect to a surface.
Figure 3:
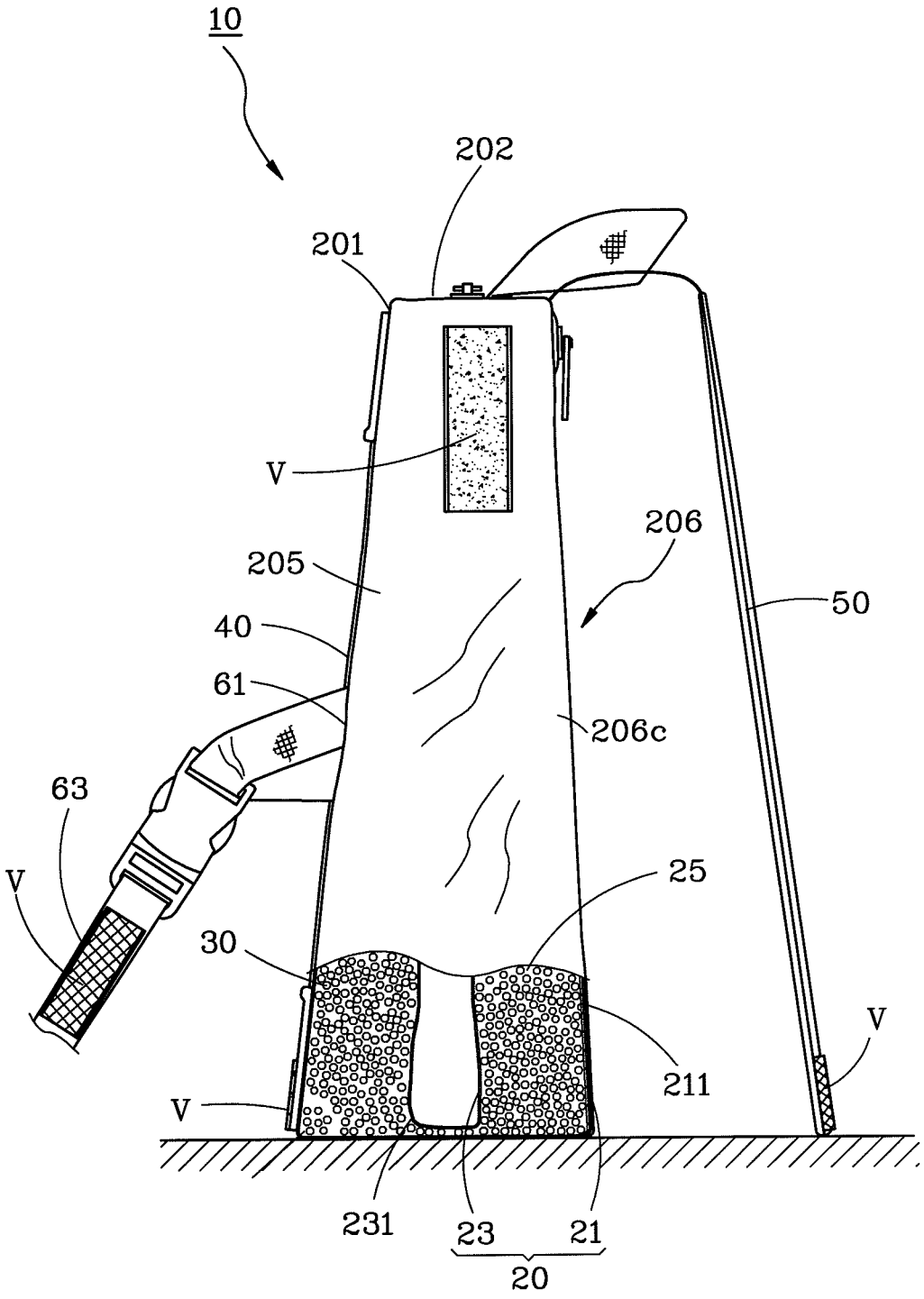
FIG. 3 is a lateral schematic view of the first preferred embodiment of the present invention, illustrating that the fillers are received in the chamber and the bridge portions of the carrying strap have not been connected with the main body.

Referring to FIGS. 1-3, a supporting apparatus 10 constructed according to a first preferred embodiment of the present invention is composed of a main body 20, a plurality of fillers 30, a transparent film 40, a protective shield 50, and a carrying strap 60.

The main body 20 is formed of an external bag 21 and an internal bag 23. The internal bag 23 is mounted inside the external bag 21. An external wall 231 of the internal bag 23 and an internal wall 211 of the external bag 21 jointly define a chamber 25. Subject to the user's requirement, things can be put into the internal bag 23. Next, as shown in FIGS. 1-2, the main body 20 includes an external lateral surface 201, a left side 203 and a right side 205, both of which abut on the left and right sides of the external lateral surface 201, a top side 202 and a bottom side 204, both of which abut on the top and bottom sides of the external lateral surface 201, a middle portion 206 located between the top and bottom sides 202 and 204, and a locating portion 207 located on the external lateral surface 201. Besides, the middle portion 206 includes a top section 206*a* and a bottom section 206*b*, both of which are close to the top and bottom sides 202 and 204, and a middle section 206*c* located at the top and bottom sections 206*a* and 206*b*.

The fillers 30 can be spherical polymeric foam, like styrofoam ball, or other lightweight supporting matter, or other personal articles that can be put inside the external bag 21. The fillers 30 can be put into the chamber 25 in such a way that the main body 20 put on a surface can be supported by the fillers 30 to define a predetermined angle θ with respect to the surface.

Figure 4:
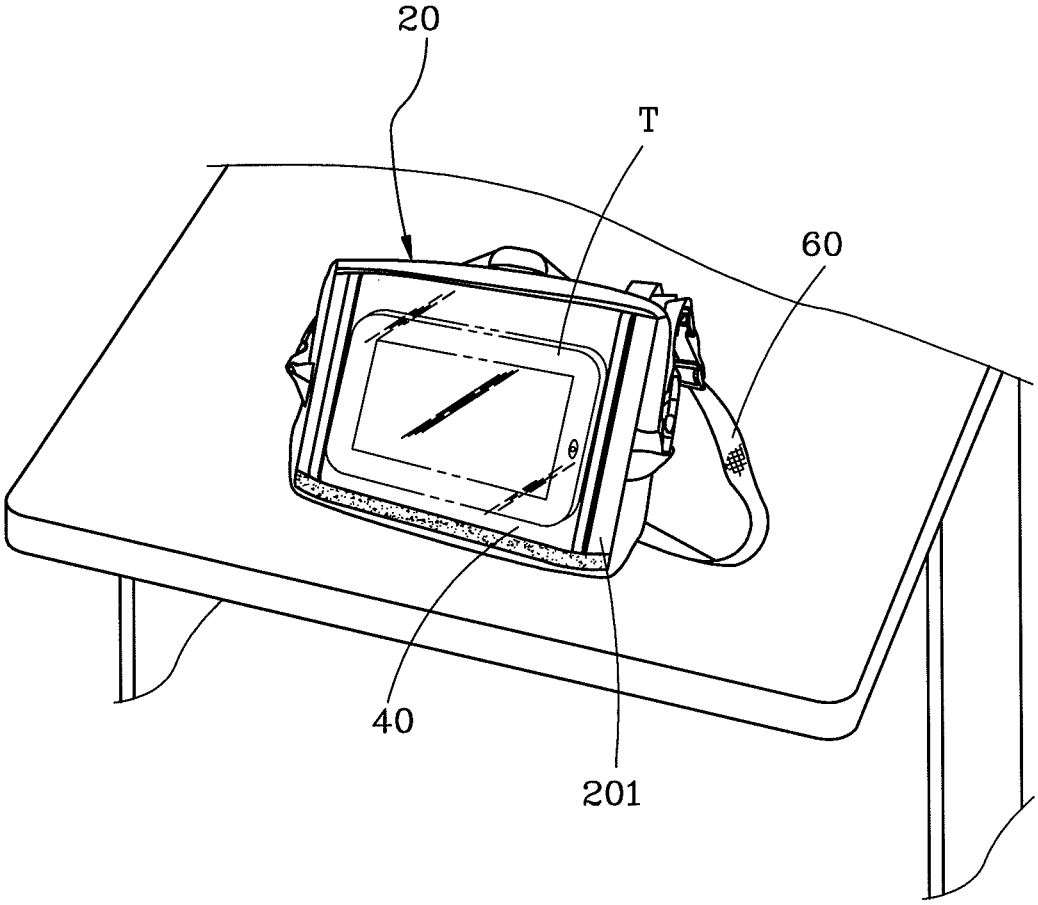
FIG. 4 is a perspective view of the first preferred embodiment of the present invention put on a tabletop.
Figure 5:
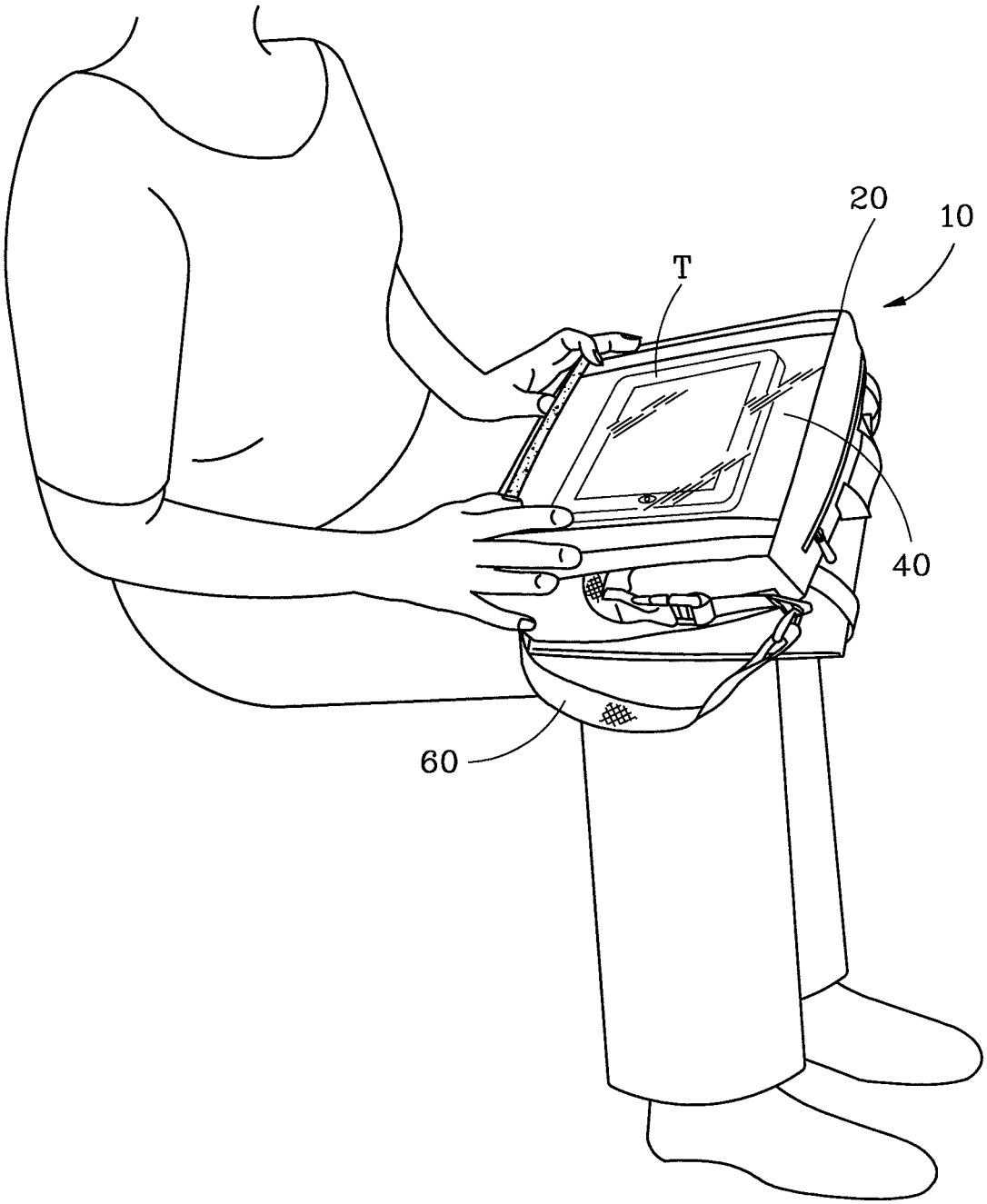
FIG. 5 is a perspective view of the first preferred embodiment of the present invention, illustrating that the user puts the supporting apparatus containing the thin electronic product on his or her legs.

The transparent film 40 coats the external lateral surface 201 of the main body 20 and includes a top lateral 401 and a bottom lateral 403, both of which are stitched to the main body 20 and define the locating portion 207 with the external lateral surface 201. Left ad right laterals 405 and 407 are provided with hooks and loops (not shown), which can be engaged with hooks and loops V mounted to the external lateral surface 201 in such a way that the left and right laterals 405 and 407 and the external lateral surface 201 can jointly form an opening 41, which can be closed. As shown in FIG. 4, a thin electronic product T, e.g. tablet computer, iPAD, etc., can be put through the opening 41 and fixed between the transparent film 40 and the external lateral surface 201 and then the user can put the supporting apparatus 10 on a tabletop or on his or her legs, as shown in FIG. 5; the user can adjust the position of the fillers 30 inside the main body 20 to change the angle between the thin electronic product T and the tabletop or the legs for adjusting the user's view angle, such that the user can comfortably operate the thin electronic product T.

Figure 6:
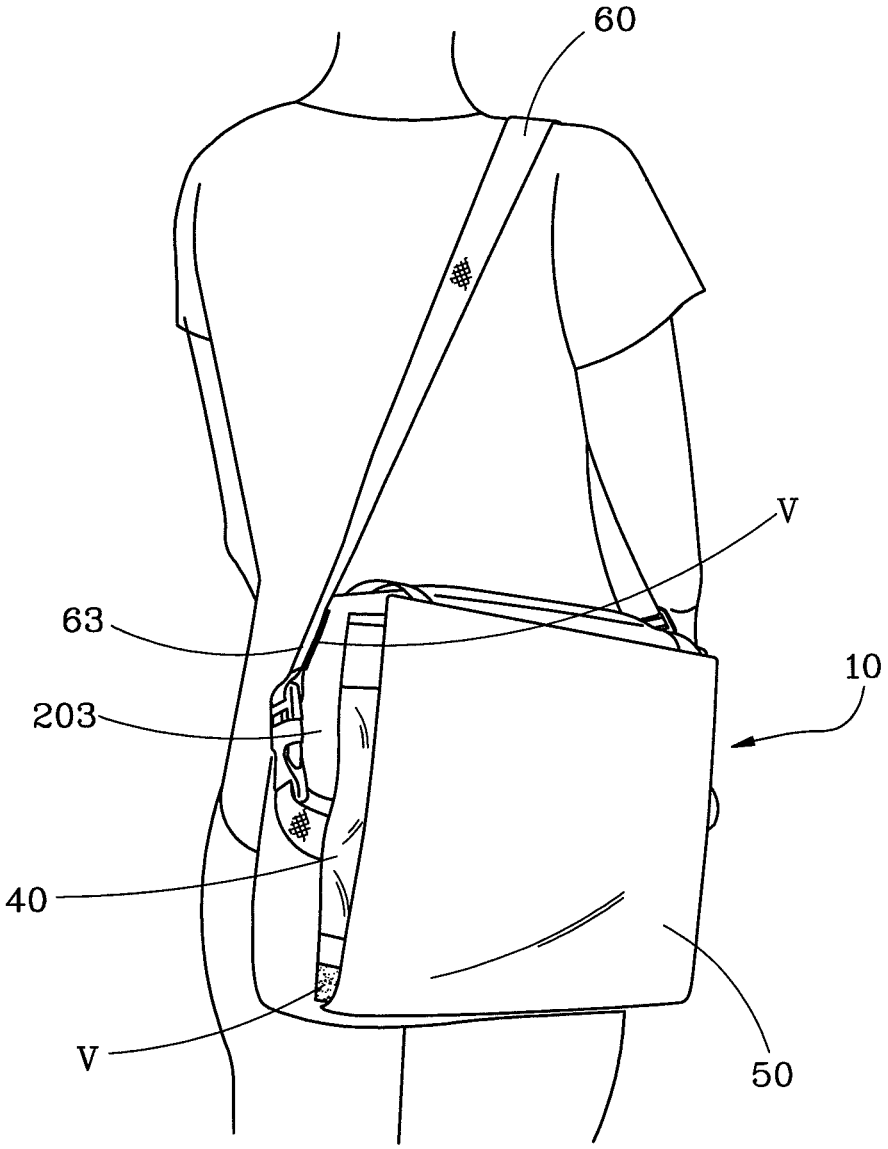
FIG. 6 is a perspective view of the first preferred embodiment of the present invention, illustrating that the user shoulders the supporting apparatus as the bridge portions of the carrying strap are mounted to the left and right sides of the main body separately.

The protective shield 50 is made of a crashworthy material and is provided with two ends, one of which is mounted to the main body 20, as shown in FIGS. 2 and 3. The protective shield 50 is covered onto the external lateral surface 201 and the transparent film 40, as shown in FIG. 6, for protecting the thin electronic product T. The protective shield 50 can also be uncovered from the external lateral surface 201 of the main body 20. Besides, to make the protective shield 50 be covered onto the transparent film 40 more firmly, the protective shield 50 can further include hooks and loops V for engagement with the hooks and loops V mounted to the transparent film 40.

The carrying strap 60 includes two end portions 61 and two bridge portions 63 close to the two end portions 61 separately. As shown in FIG. 1, the two end portions 61 are mounted to the main body 20 and spaced from each other. In this embodiment, the two end portions 61 are mounted to the junction of the external lateral surface 201 and the left and right sides 203 and 205 and located at the middle portion 206. In actual production, the locations of the two end portions 61 are not limited to the aforesaid ones and can be mounted to either positions of the middle section 206*c*. Besides, as shown in FIG. 3, each of the bridge portions 63 is provided with hooks and loops V and detachably engaged with the hooks and loops V of the left and right sides 203 and 205.

Figure 7:
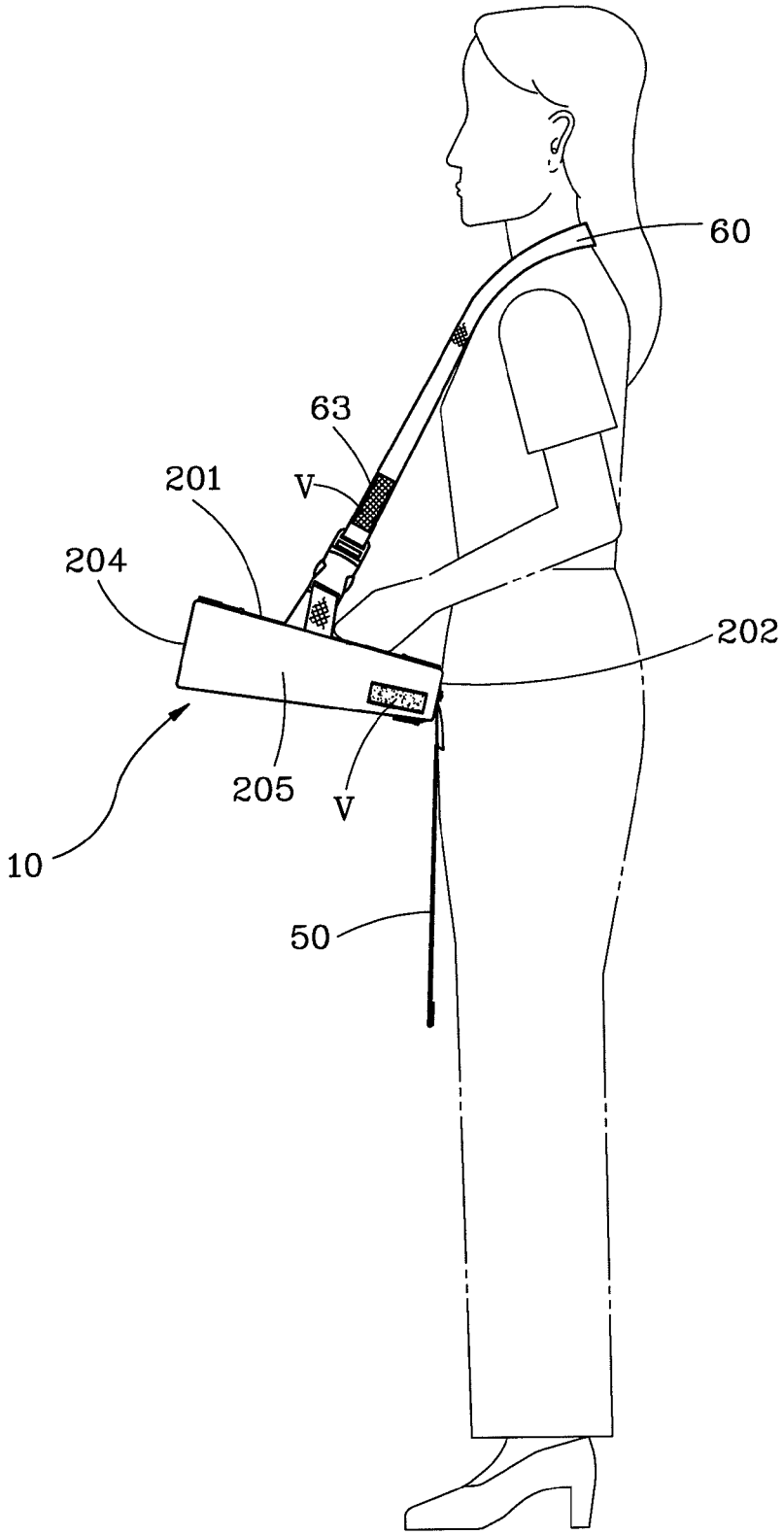
FIG. 7 is a schematic view of the first preferred embodiment of the present invention, illustrating that the user slings the carrying strap over the neck as the bridge portions of the carrying strap are not mounted to the left and right sides of the main body separately.

Referring to FIG. 6, when the two bridge portions 63 are engaged with the left and right sides 203 and 205, the user can shoulder the supporting apparatus 10 to conveniently carry the thin electronic product. On the other hand, as shown in FIG. 7, when the two bridge portions 63 are not engaged with the left and right sides 203 and 205 and the user slings the carrying strap 60 over the neck, the user can make the top side 202 or the bottom side 204 contact against his or her body via the end portions 61 mounted to the middle section 206*c* to make the external lateral surface 201 face upward in such that way the user can operate the thin electronic product while the user is walking. When the user no longer needs to operate the thin electronic product, the user only needs to disable the top side 202 or the bottom side 204 from contacting against the user's body in such a way that the supporting apparatus 10 can be vertically hung.

As recited above, the fillers filling the chamber can enable the main body of the supporting apparatus and a surface to form an inclined angle, so the thin electronic product fixed to the external lateral surface of the main body can be held on the surface to allow the user to adjust the view angle subject to individual need. Even if the main body does not have any internal bag, it can also attain the objectives of the present invention if the personal articles are treated as the fillers and put inside the external bag. Besides, the two bridge portions are not engaged with the left and right sides of the main body to allow the user to operate the thin electronic product while walking, Referring to FIG. 8, a supporting apparatus 10 constructed according to a second preferred embodiment of the present invention is similar to that of the first embodiment, having the main body 20, the fillers 30, the protective shield 50, and the carrying strap 60. The difference between the first and second embodiments is recited below.

Figure 8:
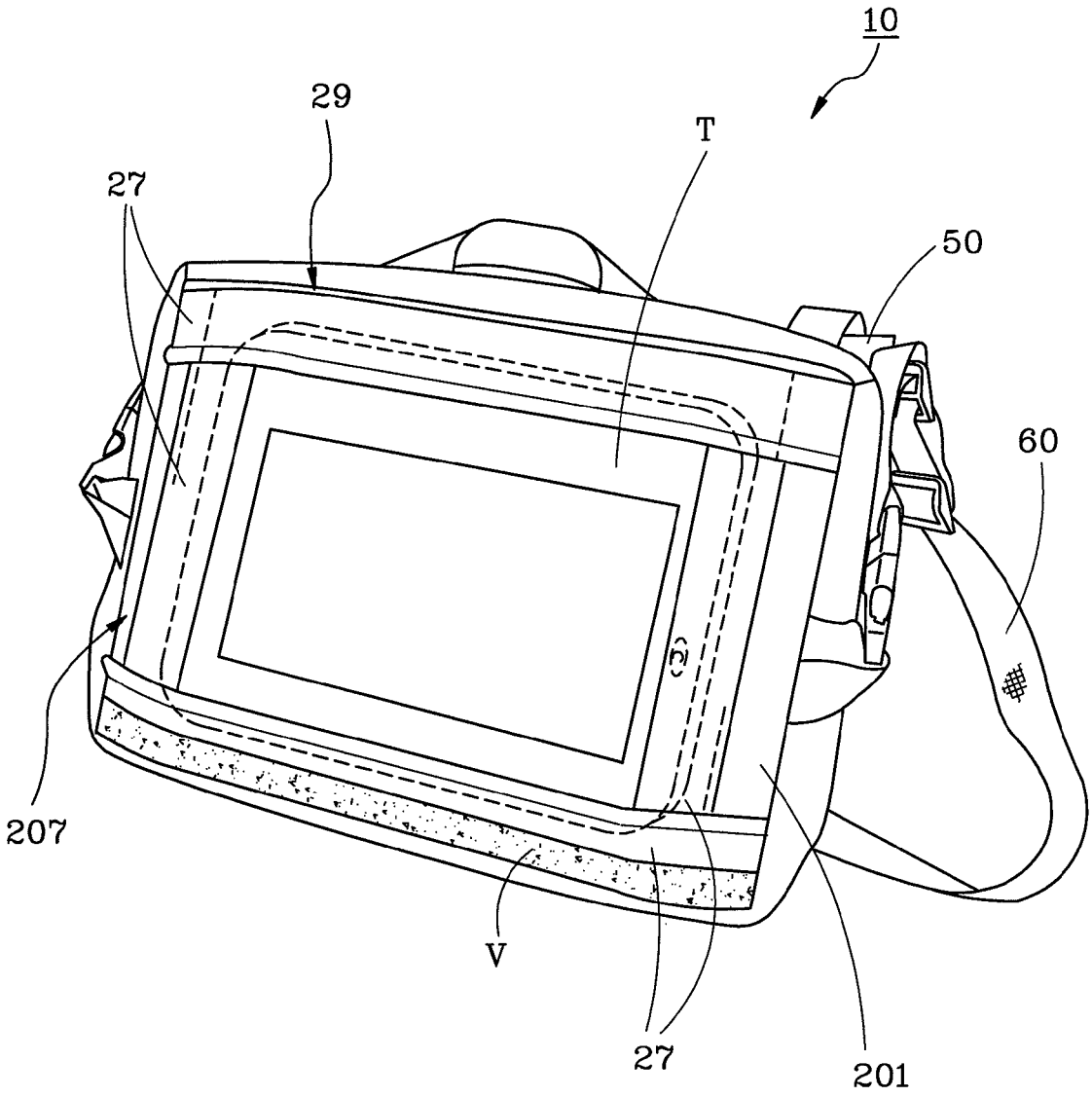
FIG. 8 is a perspective view of a second preferred embodiment of the present invention.
Figure 9:
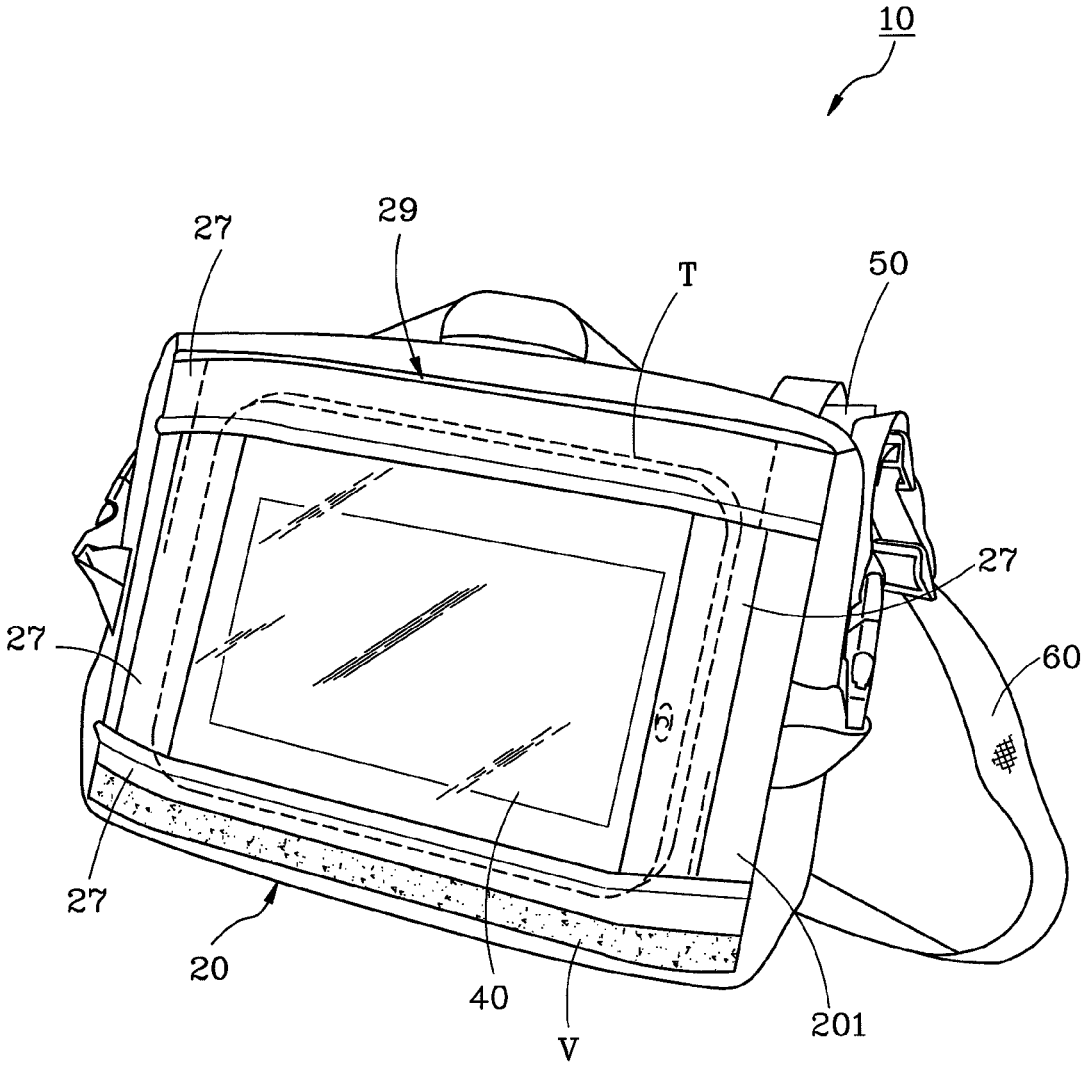
FIG. 9 is a perspective view of the second preferred embodiment of the present invention having the transparent film.

What the supporting apparatus of the second embodiment is different from that of the first embodiment lies in the pattern of the locating portion 207. In this embodiment, the external lateral surface 201 is stitched with four side strips 27, which are interconnected and surround a peripheral edge of the external lateral surface 201 of the main body 20 and jointly define the locating portion 207. Each side strip 27 is non-slip and has stronger fixity, such as, but not limited to seat belt. In this embodiment, the external lateral surface 201 and the side strip 27 located at the upper side of the main body 20 jointly form an opening 29, which can be closed. In this way, as shown in FIG. 8, the thin electronic product T can be inserted through the opening 29 into the chamber 25 and held by the side strips 27 to be fixed between the side strips 27 and the external lateral surface 201. In addition, the side strip 27 located at the lower side of main body 20 can also be provided with hooks and loops V for engagement with the hooks and loops V of the protective shield 50. In actual production, as shown in FIG. 9, the supporting apparatus 10 can further include a transparent film 40 coating the side strips 27 for protection of a screen of the thin electronic product T.

Figure 10:
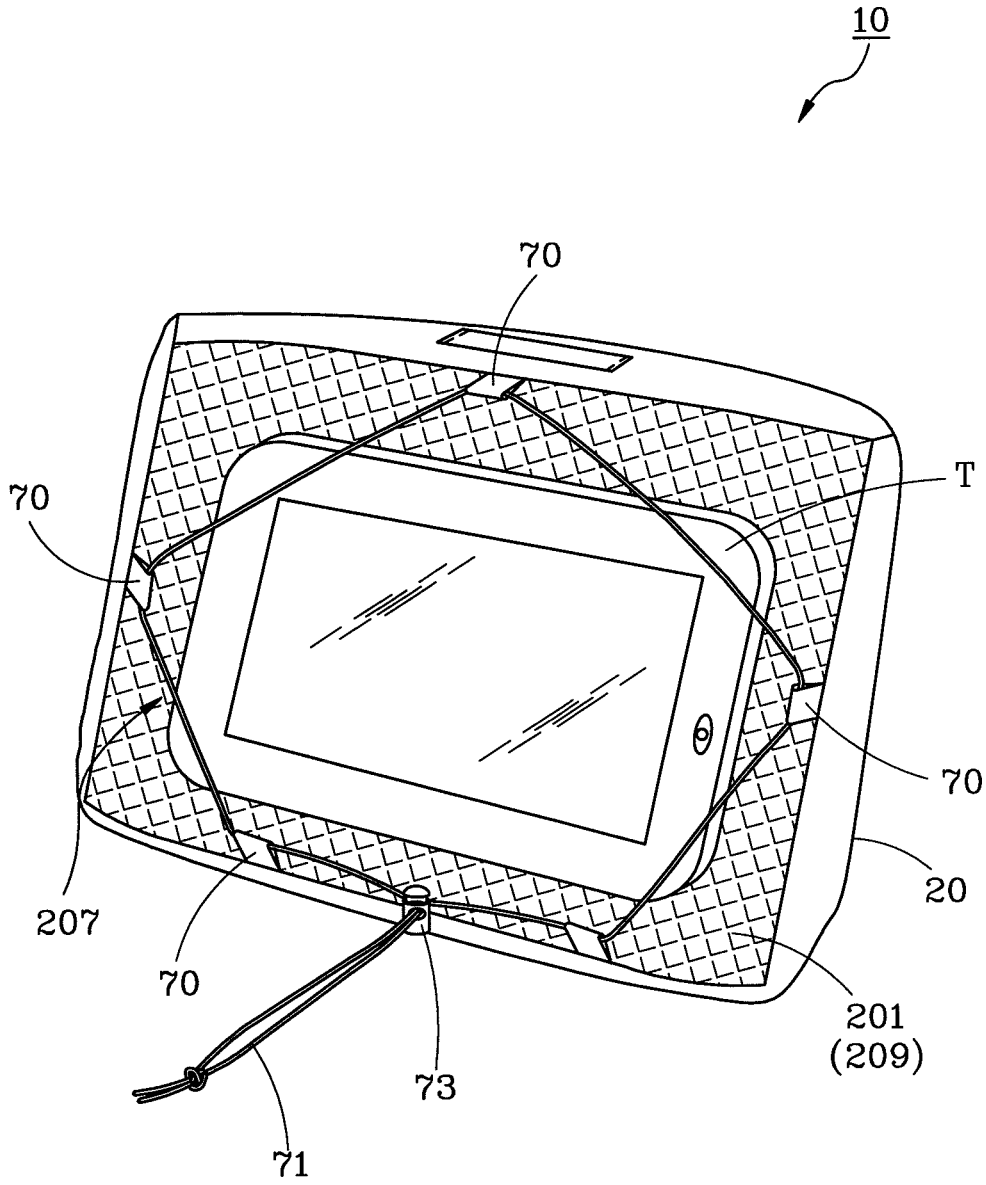
FIG. 10 is a perspective view of a third preferred embodiment of the present invention, to which a thin electronic product is fixed.
Figure 11:
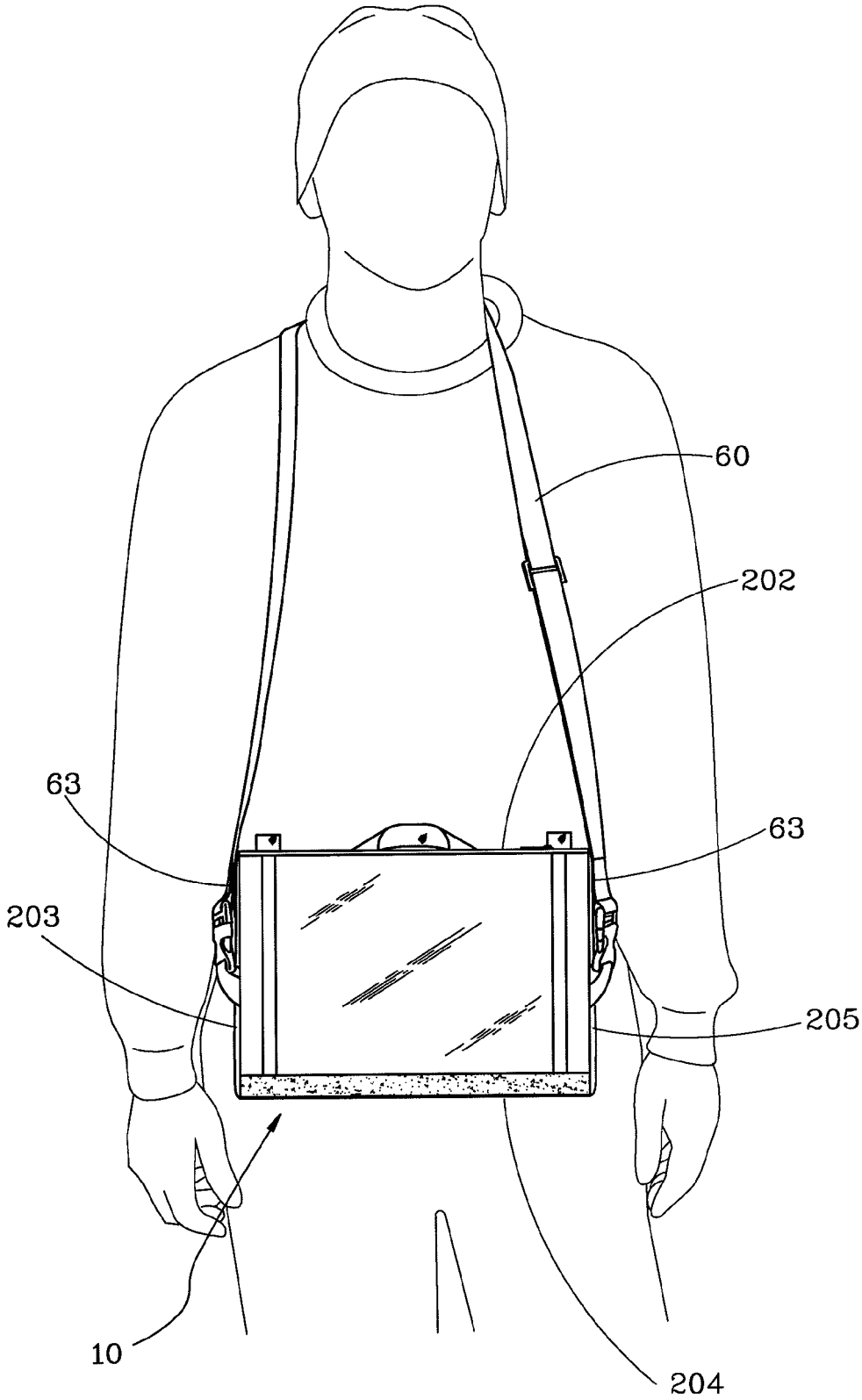
FIG. 11 is a schematic view of the first preferred embodiment of the present invention, illustrating that the user slings the carrying strap over the neck as the bridge portions of the carrying strap are mounted to the left and right sides of the main body separately.

Referring to FIG. 10, a supporting apparatus 10 constructed according to a third preferred embodiment of the present invention is similar to that of the first embodiment, having the following difference as recited below.

What the third embodiment is different from the first embodiment lies in the pattern of the locating portion 207, and the aforesaid carrying strap 60 is not available in the third embodiment. In this embodiment, an anti-skid portion 209 is mounted to the external lateral surface 201, five sleeve portions 70 are mounted to the peripheral edge of the external lateral surface 201 and spaced from each other, and a springy string 71 passes through the sleeve portions 70 out of a tightener 73. The sleeve portions 70, the springy string 71, the tightener 7, and the external lateral surface 201 jointly define the locating portion 207. In this way, as shown in FIG. 10, the anti-skid portion 209 and adjusting the tightness of the springy string 71 via the tightener 73 can prevent the thin electronic product T from easy deviation to firmly fix the thin electronic product T to the midst of the springy string 71 and the external lateral surface 201. In actual production, the number of the sleeve portion 70 is not limited as long as the thin electronic product T can be firmly fixed to the external lateral surface 201. Besides, the carrying strap 60 can be mounted to the supporting apparatus 10 as it is required in actual production.

In conclusion, the supporting apparatus of the present invention can change the position of the fillers inside the chamber to further adjust the view angle, so the present invention improves the drawback of the prior art that the thin electronic product can only be put on the tabletop horizontally. Besides, the present invention further includes the supporting apparatus, so the user can more conveniently carry the thin electronic product and operate the same while the user is walking to facilitate the operation of the user who needs to inspect factory.

Although the present invention has been described with respect to specific preferred embodiments thereof, it is no way limited to the details of the illustrated structures but changes and modifications may be made within the scope of the appended claims.

What is claimed is:

1. A supporting apparatus for a thin electronic product, comprising:

a main body having a chamber, an external lateral surface, and a locating portion located on the external lateral surface, the locating portion being adapted for visibly fastening the thin electronic product to the external lateral surface; the main body further having at least one interconnected side strip formed on the external lateral surface of the main body, at least one side strip and the external lateral surface of the main body jointly forming an opening, which can be closed, the at least one side strip and the external lateral surface of the main body jointly defining the locating portion; and a plurality of fillers mounted inside the chamber;

whereby the thin electronic product can be put on a surface via the main body and the fillers and define a predetermined angle with respect to the surface, and wherein the main body comprises four interconnected side strips formed on the external later surface of main body and surrounding a peripheral edge of the external lateral surface of main body.

2. The supporting apparatus as defined in claim 1 further comprising a protective shield, which is mounted to the main body and covered onto the external lateral surface of the main body, wherein the protective shield can be uncovered from the external lateral surface of the main body.

3. The supporting apparatus as defined in claim 1, wherein the main body comprises a left side and a right side close to the external lateral surface; the supporting apparatus further comprises a carrying strap having two end portions and two bridge portions, the two end portions being mounted to the main body and spaced from each other, the two bridge portions close to the two end portions respectively and. detachably mounted to the left and right sides of the main body.

4. The supporting apparatus as defined in claim 3, wherein the main body comprises a top side and a bottom side close to the external lateral surface of the main body, a middle portion located between the top and bottom sides and having a top section and a bottom section close to the top and bottom sides respectively, and a middle section located between the top and bottom sections; the two end portions of the carrying strap are mounted to the middle section of the middle portion of the main body.

5. The supporting apparatus as defined in claim 1, wherein the main body further comprises an external bag and an internal bag mounted inside the external bag, whereby an external wall of the internal bag and an internal wall of the external bag jointly define the chamber of the main body.

6. The supporting apparatus as defined in claim 1, wherein the main body further comprises a transparent film coating the external lateral surface, at least one of lateral sides of the transparent film and the external lateral surface of the main body jointly forming an opening, which can be closed, the transparent film and the external lateral surface jointly defining the locating portion.

7. The supporting apparatus as defined in claim 1, further comprising a transparent film coating the at least one side strip.

8. The supporting apparatus as defined in claim 1, further comprising a protective shield, which is mounted to the main body and covered onto the at least one side strip, wherein the protective shield can be uncovered from the at least one side strip.

9. The supporting apparatus as defined in claim 1, wherein the main body further comprises at least five sleeve portions mounted to a peripheral edge of the external lateral surface, a springy string passing through the sleeve portions, and a tightener for the springy string to pass through, whereby, the external lateral surface of the main body, the sleeve portions, the springy string, and the tightener jointly define the locating portion.

* * * * *